US007061457B2

(12) United States Patent
Minami

(10) Patent No.: US 7,061,457 B2
(45) Date of Patent: Jun. 13, 2006

(54) FLAT DISPLAY APPARATUS WITH SPACERS BETWEEN FIRST PANEL SUBSTRATE AND SECOND PANEL SUBSTRATE, AND METHOD OF MANUFACTURING THE SAME

(75) Inventor: Masaru Minami, Kanagawa (JP)

(73) Assignee: Sony Corporation (JP)

( * ) Notice: Subject to any disclaimer, the term of this patent is extended or adjusted under 35 U.S.C. 154(b) by 363 days.

(21) Appl. No.: 10/624,604

(22) Filed: Jul. 23, 2003

(65) Prior Publication Data

US 2004/0195956 A1 Oct. 7, 2004

(30) Foreign Application Priority Data

Aug. 5, 2002 (JP) ..... P2002-226981

(51) Int. Cl.
*H01J 31/00* (2006.01)

(52) U.S. Cl. ..... 345/87; 349/56; 349/155; 349/156; 349/158

(58) Field of Classification Search ..... 345/87; 349/56, 155, 156, 158, 190; 313/493; 445/24, 445/25

See application file for complete search history.

(56) References Cited

U.S. PATENT DOCUMENTS 5,561,343 A * 10/1996 Lowe ..... 313/482
6,004,423 A * 12/1999 Ruedin et al. ..... 156/292
6,580,026 B1 * 6/2003 Koyanagi et al. ..... 136/263
2001/0040667 A1 * 11/2001 Sasaki ..... 349/190
2002/0027636 A1 * 3/2002 Yamada ..... 349/155
2002/0053515 A1 * 5/2002 Nemelka ..... 204/485
2002/0053688 A1 * 5/2002 Gonzalez et al. ..... 257/288
2002/0075443 A1 * 6/2002 Shimizu et al. ..... 349/155
2003/0043333 A1 * 3/2003 Miyazaki ..... 349/155

* cited by examiner

*Primary Examiner*—Bipin Shalwala
*Assistant Examiner*—Vincent E. Kovalick
(74) *Attorney, Agent, or Firm*—Rader, Fishman & Grauer, PLLC; Ronald P. Kananen

(57) ABSTRACT

A flat display apparatus with spacers between a first panel substrate and a second panel substrate and a method of manufacturing the same are disclosed. The spacers are interposed between an anode substrate and a cathode substrate. The spacers are each formed to have an elongate sheet structure and to be elastically deformable in the thickness direction thereof. A plurality of projected portions is provided on each of the black stripes of the anode substrate, and each spacer is fastened to the plurality of projected portions by a recoil strength obtained when the spacer is elastically deformed. By this, each spacer is supported in an upright condition on the anode substrate by the plurality of projected portions. There is no need for an adhesive or the like for supporting the spacers in the upright condition.

6 Claims, 5 Drawing Sheets

FLAT DISPLAY APPARATUS WITH SPACERS BETWEEN FIRST PANEL SUBSTRATE AND SECOND PANEL SUBSTRATE, AND METHOD OF MANUFACTURING THE SAME

BACKGROUND OF THE INVENTION

The present invention relates to a flat display apparatus with spacers between a first panel substrate and a second panel substrate and a method of manufacturing the same.

When an electric field above a threshold value is applied to the surface of a conductor, such as a metal, or a semiconductor placed in vacuum, electrons pass through a potential barrier under the tunnel effect, and the electrons are emitted into the vacuum even at normal temperature. This phenomenon is called field emission, and a device emitting electrons by field emission is called a field emission device.

In recent years, attention has been paid to a field emission display (FED) in which a field emission device of the Spindit type, the thin film type, or the like are used as an emitter. The FED is a flat display apparatus in which a multiplicity of field emission devices are provided on a cathode electrode by use of semiconductor technology or the like. The FED is a system in which electrons are emitted by field concentration from the field emission devices in an electron emission unit, which are selected electrically, the electrons are caused to impinge on phosphors on the anode substrate side, and excitation or light emission of the phosphors is induced, whereby an image is displayed.

The FED has a structure in which a cathode substrate and an anode substrate are disposed opposite to each other, with a minute gap therebetween, and the gap space portion in a vacuum condition is encapsulated. Therefore, in order that the cathode substrate and the anode substrate can endure the atmospheric pressure, spacers are mounted between the substrates so as to support the substrates by the spacers.

The FEDs are generally classified into the low voltage type and the high voltage type, according to the level of the voltage impressed on the anode electrode for causing an electron beam to impinge on the phosphors to induce light emission, namely, the anode voltage. The spacers, particularly those used in a high voltage type FED, have a very high aspect ratio; for example, the spacers have a height of 1 to 2 mm and a thickness of 0.05 to 0.1 mm. Therefore, it is difficult for the spacers to stand on the substrate by themselves. Accordingly, some means for supporting the spacers is needed.

However, in the process of manufacturing an FED, it is necessary to mount a large number of spacers on the substrate, according to the screen size. Therefore, in the case of an FED with a large screen size, it is demanded to simplify the process of mounting the spacers. For the conventional FEDs, there have been used a method of fixing the spacers on the substrate by use of an adhesive, a method of supporting the spacers by sandwiching them between pairs of glippers provided on the substrate correspondingly to the thickness of the spacers, and so on. Such methods, however, have the drawback that a series of manufacturing steps, such as chucking of the spacers and positioning of the spacers, are very complicated. In addition, in the method of using the pairs of glippers, it is necessary to insert each spacer into the gap between the pair of glippers so as to clamp the spacer. In order to obtain an appropriate clamping force, it is necessary to rigorously control the gap size of the pairs of glippers and the thickness of the spacers, and such control requires much labor and cost.

SUMMARY OF THE INVENTION

It is an object of the present invention to provide a display apparatus with spacers between a first panel substrate and a second panel substrate, in which the spacers can be supported easily and securely, without the need for an adhesive or the like or for rigorous control of the dimensions of component parts or the like, and a method of manufacturing the same.

In accordance with the present invention, there is provided a display apparatus including spacers intermediately disposed between a first panel substrate and a second panel substrate, the spacers being so formed as to be elastically deformable, and a plurality of projected portions provided at spacer mount positions on the first panel substrate, wherein the spacers are fastened to the plurality of projected portions by a recoil strength obtained when the spacers are elastically deformed.

In the display apparatus constituted as above, the spacers are fastened to the plurality of projected portions by the recoil strength obtained when the spacers are elastically deformed, whereby the spacers are supported in an upright condition on an anode substrate.

According to the present invention, the spacers can be supported easily and securely by the plurality of projected portions, without need for rigorous control of the outside dimensions and positional accuracy of the projected portions, the thickness of the spacers, or the like.

BRIEF DESCRIPTION OF THE DRAWINGS

These and other objects of the invention will be seen by reference to the description, taken in connection with the accompanying drawing, in which:

FIGS. 8A and 8B illustrate another specific example of the supported condition of the spacer, in which FIG. 8A shows the condition where the spacer has an arcuate shape in the absence of external forces and FIG. 8B illustrates the condition where the spacer shown in FIG. 8A is supported in a rectilinear shape by pressure contact with a plurality of projected portions;

DETAILED DESCRIPTION OF THE PREFERRED EMBODIMENTS

Figure 1:
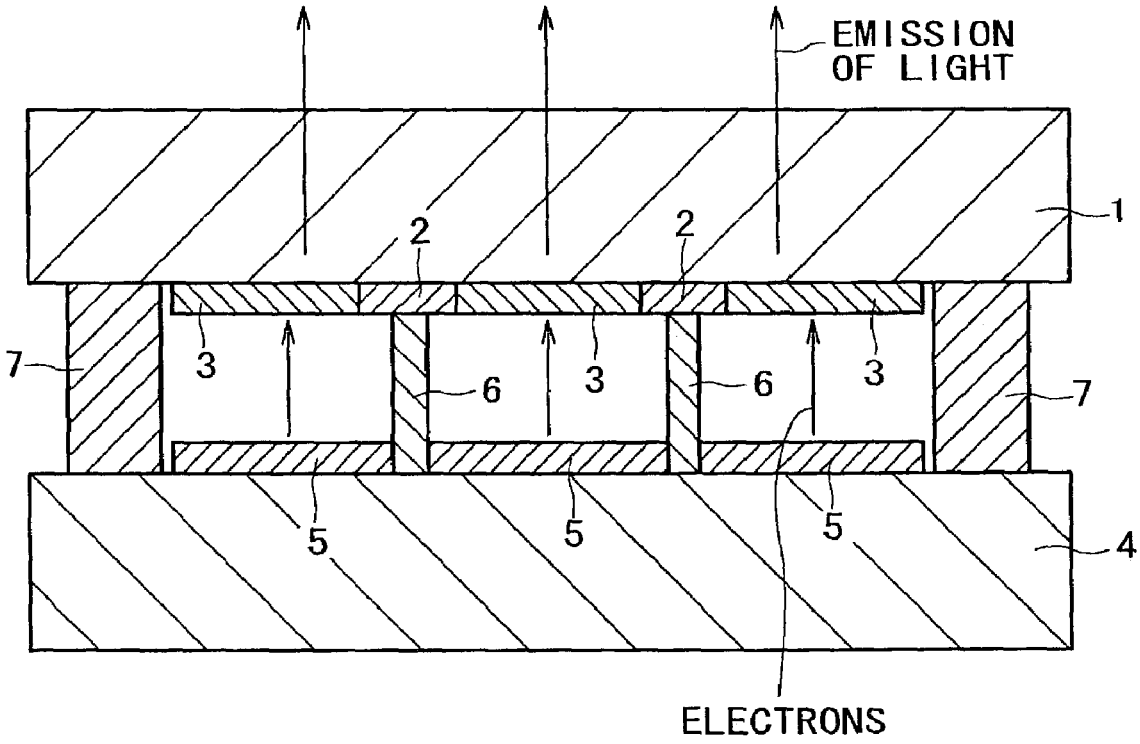
FIG. 1 is a general sectional view of an exemplary structure of a flat display apparatus to which the present invention is applied.

Now, an embodiment of the present invention will be described in detail below by referring to the drawings.

FIG. 1 is a general sectional view of an exemplary structure of a flat display apparatus to which the present invention is applied.

In the figure, black stripes 2 and phosphors 3 are formed on one side of a flat, plate-like anode substrate 1. The anode substrate 1 constitutes a front substrate of the flat display apparatus and is composed of, for example, a transparent glass substrate. The black stripes 2 are arranged in a matrix form as viewed from the front side of the display apparatus, namely, from the upper side of FIG. 1; therefore, the black stripes 2 are also called a black matrix. The width of the black stripes 2 depends on the screen size of the display apparatus and the resolution of the display; generally, the width is set in the range of 100 to 200 μm. The phosphors 3 are formed at a predetermined pitch on one side of the anode substrate 1, so as to fill up the gaps between the black stripes 2. For example, the black stripes 2 and the phosphors 3 are formed on an anode (not shown) laminated on one side of the anode substrate 1. The anode is composed of a transparent electrode of ITO (Indium Tin Oxide), for example. Incidentally, a structure may be adopted in which the anode is laminated on the black stripes 2 and the phosphors 3. The anode substrate 1 constituted as above corresponds to the first panel substrate in the present invention.

On the other hand, emitters 5 are formed on one side of a flat, plate-like cathode substrate 4, namely, on the side of the cathode substrate 4 facing the anode substrate 1. The cathode substrate 4 constitutes a back substrate of the display apparatus and is composed of, for example, an insulating substrate formed of a glass or the like. The emitters 5 are for emitting electrons by field emission, and they are formed at a predetermined pitch on one side of the cathode substrate 4 in correspondence with the phosphors 3 on the side of the anode substrate 1. The emitters 5 are formed on cathodes (not shown) laminated on one side of the cathode substrate 4. In addition, the emitters 5 are formed at intersections between the cathodes (not shown) and gate electrodes laminated on the cathodes, with an insulating layer therebetween, on one side of the cathode substrate 4. The cathode substrate 4 constituted as above corresponds to the second panel substrate in the present invention.

A plurality of spacers 6 are interposed between the anode substrate 1 and the cathode substrate 4. In FIG. 1, only two spacers are shown for convenience. The peripheral portion of the display apparatus composed of the anode substrate 1 and the cathode substrate 4 is sealed with a frit seal 7. The spacers 6 are provided for a pressure resistance purpose, i.e., provided so that the anode substrate 1 and the cathode substrate 4 can endure the atmospheric pressure when the inside of the display apparatus is brought into a vacuum condition. The spacers 6 provide a fixed gap between the anode substrate 1 and the cathode substrate 4. In addition, the spacers 6 are arranged on the black stripes 2, so as not to produce bad effects on the image displayed. The frit seal 7 is provided in a frame form along the outer shape of the anode substrate 1 and the cathode substrate 4. The frit seal 7 maintains the gap space between the anode substrate 1 and the cathode substrate 4, namely, the inside of the display apparatus in a vacuum condition.

Figure 2:
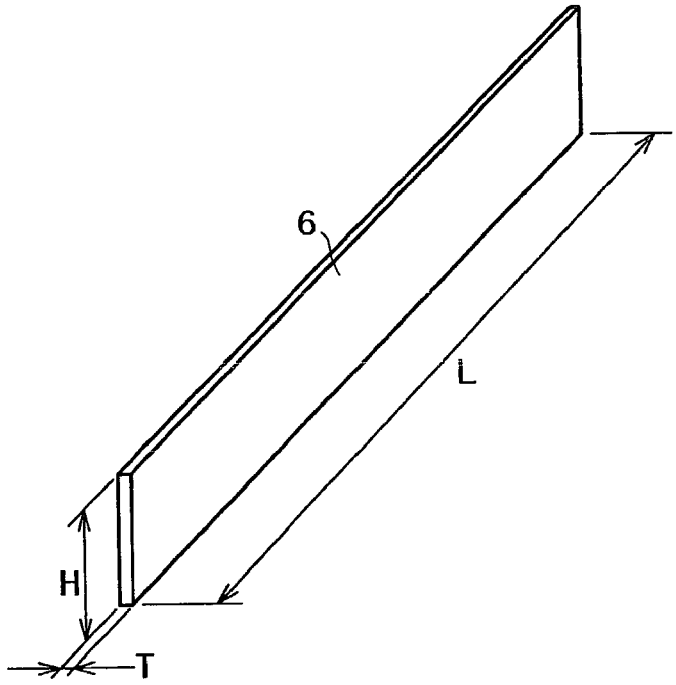
FIG. 2 is a perspective view of a spacer adopted in an embodiment of the present invention.

FIG. 2 is a perspective view of the spacer 6 adopted in the embodiment of the present invention. As shown, the spacer 6 has an elongate sheet structure as a whole. The dimensions of the spacer 6 are determined according to the size of the display apparatus and the like. For example, in a high voltage-type FED, a spacer having a height H=2 mm, a thickness T=100 μm, and a length L=100 mm is used. As the material for the spacer 6, for example, an insulating material such as a ceramic and a glass is used.

Figure 3A:
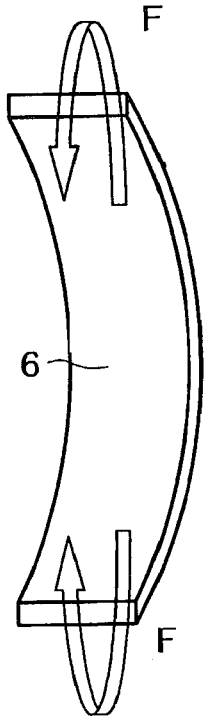
FIG. 3A illustrates the elastic deformation characteristic of the spacer adopted in the embodiment of the present invention, showing how the spacer is bent under external forces.
Figure 3B:
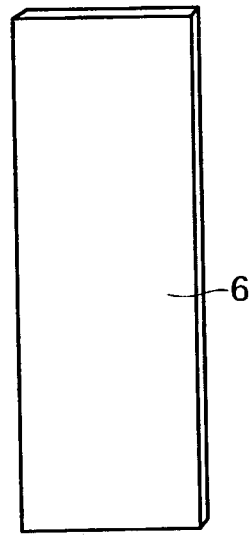
FIG. 3B shows the condition where the spacer shown in FIG. 3A has returned to its original rectilinear form in the absence of external forces.

While the spacer 6 is formed originally in a rectilinear shape, it has a characteristic that when external forces F are exerted thereon in the directions of the arrows in FIG. 3A, it is elastically deformed in the thickness direction according to the external forces F. This characteristic is obtained by setting the thickness of the spacer 6 to be small. In addition, the spacer 6 also has a characteristic that when the external forces F exerted thereon as above are removed, it returns to its original shape as shown in FIG. 3B, i.e., to the rectilinear shape in the case of FIGS. 3A and 3B. Namely, when the spacer 6 is elastically deformed, the reaction force due to the elastic deformation acts as a force (hereinafter referred to as a recoil strength) for returning the spacer 6 into its original shape.

Figure 4A:
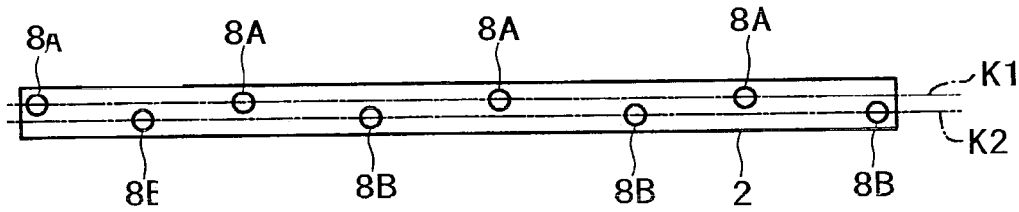
FIG. 4A illustrates an example of the formation of projected portions on an anode substrate, in which projected portions are provided on different lines on a black stripe.

On the other hand, as shown in FIG. 4A, a plurality of (in the example shown, eight) projected portions 8A and 8B is formed on the black stripe 2 on the anode substrate 1. The projected portions 8A and 8B are provided on one side of the anode substrate 1 for supporting the spacer 6 in an upright condition (vertical condition). The projected portions 8A and BB are provided in the state of being projected from the surface of the black stripe 2, and they are arranged in a staggered form along the longitudinal direction of the black stripe 2.

Figure 4B:
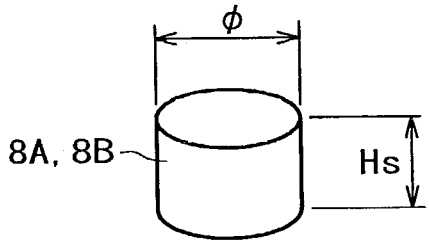
FIG. 4B shows the details of the projected portions shown in FIG. 4A.

Namely, the four projected portions 8A and the four projected portions BB are arranged on the black stripe 2 in such positional relationship as to be adjacent to each other along the longitudinal direction of the black stripe 2. Of the eight projected portions, the four projected portions 8A are disposed on a straight line axis K1 along the longitudinal direction of the black stripe 2. On the other hand, the four projected portions BB are disposed on a straight line axis K2, which is parallel to the straight line axis K1 and shifted from the straight line axis K1 in the width direction of the black stripe 2. In addition, the projected portions 8A and 8B are each formed in a cylindrical shape, as shown in FIG. 4B, and arranged at a regular pitch in the longitudinal direction of the black stripe 2.

The dimensions of the projected portions 8A and 8B depend on the height H and the thickness T of the spacer 6 and the width of the black stripe 2; for example, the projected portions 8A and 8B are set to have a diameter $\phi$=30 to 100 μm and a height Hs=30 to 100 μm. The projected portions 8A and 8B may be formed of any of various materials, such as, for example, resins, metals, ceramics, etc. Incidentally, any positions on the anode substrate 1 may be set to be the spacer mount positions, provided that the positions do not produce bad influences on the image displayed. In addition, the projected portions 8A and 8B may be provided on the cathode substrate, instead of on the black matrix.

Next, as one example of the method of manufacturing the display apparatus according to the present invention, the manufacturing procedure in the case of adopting the structure in which each of the spacers 6 is supported by use of the plurality of projected portions 8A and 8B will be described.

First, in the step of manufacturing the anode substrate 1, the anode is formed on one side of the transparent substrate for constituting the base of the anode substrate 1, and then the black stripes 2 are formed on the anode. Next, the above-mentioned plurality of projected portions 8A and 8B is formed on the black stripes 2. As a specific example of forming the projected portions 8A and 8B, there is a method in which a resin, such as polyimide, is applied to the black stripes 2 by screen printing, and the resin film thus obtained is patterned into a desired shape by photolithography, thereby obtaining the projected portions 8A and 8B. Other examples include a method in which a metallic material is applied to the black stripes 2 by plating, so as to obtain the projected portions 8A and 8B.

Thereafter, the phosphors 3 are applied to one side of the anode substrate 1, and then a metal film composed of an aluminum film is formed, as required. Subsequently, the spacers 6 formed in the rectilinear shape as above are chucked by a holding means (not shown). As the system of chucking the spacers 6, for example, vacuum suction may be adopted. In this case, external forces are exerted on the spacers 6 by the holding means so that the spacers 6 do not interfere with the plurality of projected portions 8A and 8B formed on the black stripes 2. Namely, the spacers 6 are each elastically deformed by the external forces into a curved shape, more specifically, into a wavy shape in the plan view, as indicated by the broken line in FIG. 5. The spacers 6 are assembled onto the black stripes 2 in the elastically deformed condition. The assembling of the spacers 6 is conducted by a method in which the lower end portions of the spacers 6 elastically deformed into the wavy shape by the holding means are brought into contact with the surface of the formation of the black stripes 2 on the anode substrate 1. By this, each of the spacers 6 is brought into the wavy curved condition so as not to interfere with the projected portions 8A and 8B on the black stripe 2.

With the spacers 6 thus assembled onto the black stripes 2, the external forces exerted on the spacers 6 by the holding means are removed gradually or instantaneously. The removal of the external forces, for example, in the case where vacuum suction is adopted as the system for chucking the spacers 6 by the holding means, is conducted by releasing the vacuum suction. Upon this, each spacer 6 tends to return to its original shape due to the release of the external forces, so that the recoil strength of the spacer 6 brings the spacer 6 into pressure contact with side surfaces of the projected portions 8A and 8B, as indicated by the solid line in FIG. 5. In this case, the direction of the contact pressure acting on each of the projected portions 8A on the straight line axis K1 is opposite to the direction of the contact pressure acting on each of the projected portions 8B on the straight line axis K2.

Figure 5:
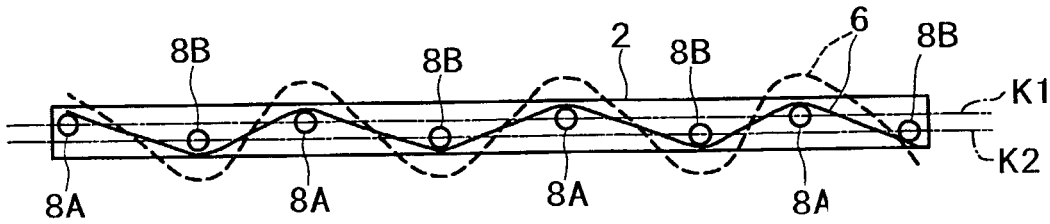
FIG. 5 illustrates the conditions of the projected portions and the spacer at the time of assembly, in which the broken line shows the condition where the spacer is deformed under external forces so as to avoid interference with the projected portions and the solid line shows the condition where the spacer is in pressure contact with the projected portions in the absence of external forces.
Figure 6:
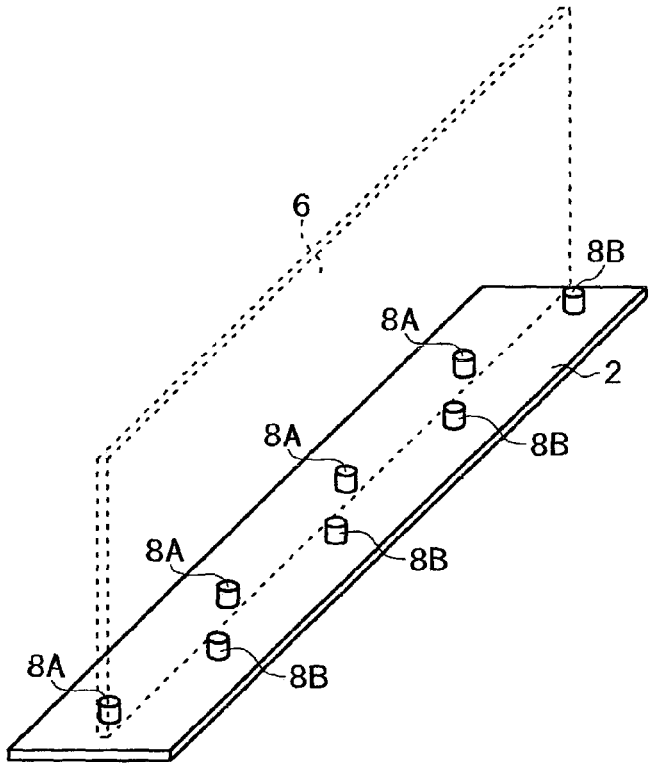
FIG. 6 is a perspective view showing the condition where the spacer is supported by a plurality of projected portions.

Namely, in FIG. 5, an upward contact pressure is exerted on the spacer 6 from each of the projected portions 8A on the straight line axis K1, whereas a downward contact pressure is exerted on the spacer 6 from each of the projected portions 8B on the straight line axis K2. In other words, the spacer 6 is fastened to the plurality of projected portions 8A and 8B by its own recoil strength. By this, as shown in FIG. 6, the spacer 6 is supported in the upright condition by the plurality of projected portions 8A and 8B on the black stripe 2 of the anode substrate 1. By mounting the plurality of spacers 6 onto the anode substrate 1 following the above-mentioned procedure, the anode substrate 1 with the spacers 6 mounted thereon is obtained.

On the other hand, in the step of manufacturing the cathode substrate 4, the cathode electrodes, the insulating layer, and the gate electrodes are sequentially laminated on one side of an insulating substrate for constituting the base of the cathode substrate 4, then openings are formed in the gate electrodes, and gate holes are formed in the insulating layer. Next, the emitters 5 are formed in the gate holes. By this, the cathode substrate 4 is obtained.

Thereafter, the anode substrate 1 with the spacers 6 mounted thereon and the cathode substrate 4, which are obtained in the substrate manufacturing steps as above-mentioned, are combined with each other by opposing them to each other. As a result, the spacers 6 are interposed between the anode substrate 1 and the cathode substrate 4. In this condition, vacuum drawing and gas-tight encapsulation by the frit seal 7 are conducted, whereby the display apparatus having a structure in which the anode substrate 1 and the cathode substrate 4 are adhered to each other as shown in FIG. 1 is obtained.

In the display apparatus having the above-mentioned structure, the spacers 6 are each fastened to the plurality of projected portions 8A and 8B by utilizing the recoil strength thereof obtained when the spacers 6 are elastically deformed, whereby the spacers 6 are supported in the upright condition on the anode substrate 1. Therefore, the spacers 6 can be supported easily and securely by use of the plurality of projected portions 8A and 8B, without the need for rigorous control of the outside dimensions and positional accuracy of the projected portions 8A and 8B, the accuracy of thickness of the spacers 6, or the like.

Figure 7A:
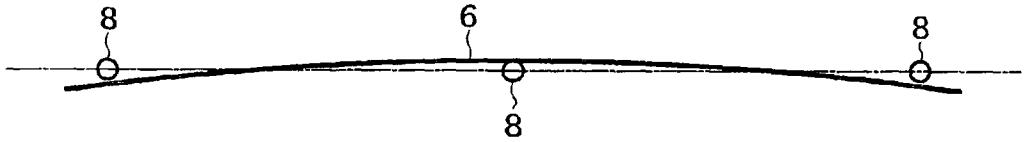
FIG. 7A illustrates another example of an arrangement of the projected portions.
Figure 7B:
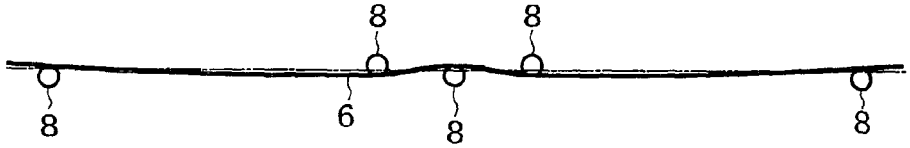
FIG. 7B illustrates a further example of an arrangement of the projected portions.

In the above-described embodiment, a total of eight projected portions 8A and 8B have been formed on the black stripe 2 in supporting one spacer 6. However, the present invention is not limited to this structure, and a minimum of three projected portions 8 may be used to support one spacer 6, as shown in FIG. 7A. In this case, the projected portions 8 are located at both end portions and an intermediate portion in the longitudinal direction of the spacer 6. Furthermore, the arrangement of the projected portions 8 may be modified variously; for example, as shown in FIG. 7B, three projected portions 8 may be arranged at a first arrangement pitch at an intermediate portion in the longitudinal direction of the spacer 6, and one projected portion 8 may be arranged at a second arrangement pitch greater than the first arrangement pitch at each of both end portions in the longitudinal direction of the spacer 6.

In the above-described embodiment, the spacers 6 are prepared in the rectilinear shape, and the rectilinear-shaped spacers 6 are each elastically deformed into the wavy shape and fastened to the plurality of projected portions 8A and 8B, whereby the spacers 6 are finally supported in the curved line shape.

Figure 8A:
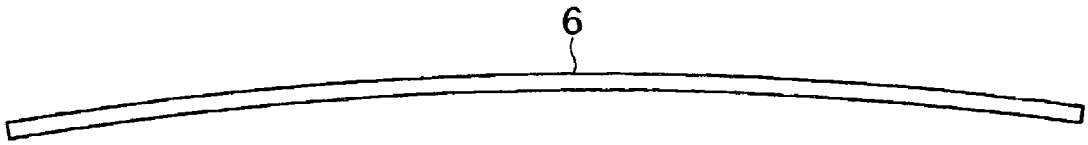
Figure 8B:
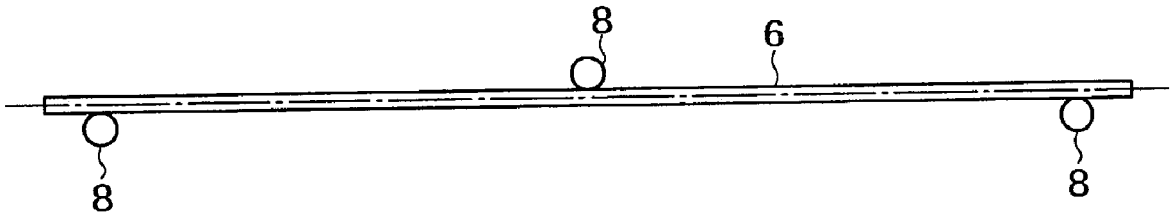

On the contrary, as for example shown in FIG. 8A, each spacer 6 may be prepared in a curved line shape, in an arcuate shape, and the spacer 6 in the curved line shape may be supported in a rectilinear shape by three projected portions 8, as shown in FIG. 8B. Furthermore, as the specific shape in the case of preparing or supporting the spacer 6 in a curved line shape, there can be used various shapes, such as an arcuate shape, a wavy shape, a S shape, etc.

In addition, though not shown, the spacer 6 may be prepared in a curved line shape and supported in another curved line shape. For example, a spacer 6 prepared in a S shape may be supported in a reverse-S shape, or a spacer 6 prepared in a wavy shape may be supported in another wavy shape, which is reverse to the original wavy shape.

Figure 9A:
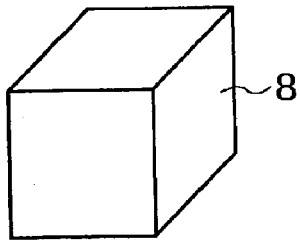
FIG. 9A illustrates another example of the shape of the projected portion.
Figure 9B:
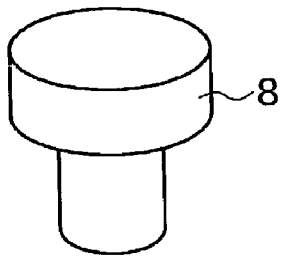
FIG. 9B illustrates a further example of the shape of the projected portion.

Furthermore, the shape of each projected portion 8 is not limited to the cylindrical shape described above, and various modifications are possible. For example, the projected portion may have a quadratic prism shape, as shown in FIG. 9A, or it may have a stepped cylindrical shape with a head portion greater in diameter than a lower portion, as shown in FIG. 9B.

While a preferred embodiment of the invention has been described using specific terms, such description is for illustrative purposes only, and it is to be understood that changes and variations may be made without departing from the spirit or scope of the following claims.

What is claimed is:

1. A field emission display comprising:

spacers interposed between a first panel substrate and a second panel substrate and so formed as to be elastically deformable, and a plurality of projected portions provided at each spacer mount position on said first panel substrate, wherein each said spacer is fastened to said plurality of projected portions by a recoil strength obtained when each said spacer is elastically deformed.

2. A field emission display as set forth in claim 1, wherein each said spacer is formed in a rectilinear shape, and each said spacer is fastened to said plurality of projected portions by a recoil strength obtained when said rectilinear-shaped spacer is elastically deformed, whereby each said spacer is supported in a curved line shape.

3. A field emission display as set forth in claim 1, wherein each said spacer is formed in a curved line shape, and each said spacer is fastened to said plurality of projected portions by a recoil strength obtained when said curved line shaped spacer is elastically deformed, whereby each said spacer is supported in a rectilinear shape.

4. A method of manufacturing a field emission display, which comprises, in interposing spacers between a first panel substrate and a second panel substrate, a step of providing a plurality of projected portions at each spacer mount position on said first substrate, and a step of elastically deforming each said spacer by an external force so as to avoid positional interference of said spacer with said plurality of projected portions, assembling said spacer into a spacer mount position on said first panel substrate in said elastically deformed condition, and releasing said external force in said assembled condition, thereby fastening said spacer to said plurality of projected portions.

5. A field emission display comprising:

a first panel substrate;

a second panel substrate;

elastic spacers interposed between a first panel substrate and a second panel substrate and so formed as to be elastically deformable, and a plurality of projected portions alternatively arranged at both end portions of each spacer mount position on said first panel substrate, wherein each said spacer is brought into pressure contact with side surfaces of the projected portions by a recoil strength obtained when each said spacer is elastically deformed.

6. A field emission display comprising:

a first panel substrate;

a second panel substrate;

a plurality of projected portions over the first panel substrate; and an elastic spacer between the first panel substrate and the second panel substrate, the elastic spacer being secured between the plurality of projected portions by a recoil strength obtained when each spacer is elastically deformed.

* * * * *